US011199016B2

(12) United States Patent
Hui et al.

(10) Patent No.: US 11,199,016 B2
(45) **Date of Patent: *Dec. 14, 2021**

(54) SWIMMING POOL CLEANING VEHICLE WITH ADJUSTABLE ROLLERS TO CONTROL WATER FLOW VELOCITY AND METHOD THEREFOR

(71) Applicant: Wing-Kin Hui, Hong Kong (CN)

(72) Inventors: Wing-Kin Hui, Hong Kong (CN); Wing-Tak Hui, Hong Kong (CN); Andrew Hui, Hong Kong (CN)

(73) Assignee: FOREVER VANTURE TECHNOLOGY LIMITED, Hong Kong (CN)

( * ) Notice: Subject to any disclaimer, the term of this patent is extended or adjusted under 35 U.S.C. 154(b) by 307 days.

This patent is subject to a terminal disclaimer.

(21) Appl. No.: 16/553,863

(22) Filed: Aug. 28, 2019

(65) Prior Publication Data

US 2019/0383050 A1 Dec. 19, 2019

Related U.S. Application Data

(63) Continuation of application No. 15/487,336, filed on Apr. 13, 2017, now Pat. No. 10,435,903.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/1654; E04H 4/1636
USPC ..... 15/1.7
See application file for complete search history.

(56) References Cited

U.S. PATENT DOCUMENTS 6,131,227 A * 10/2000 Rief ..... E04H 4/1654 15/1.7
10,435,903 B2 * 10/2019 Hui ..... E04H 4/1654

* cited by examiner

*Primary Examiner* — Laura C Guidotti
(74) *Attorney, Agent, or Firm* — Weiss & Moy, P.C.; Jeffrey D. Moy

(57) ABSTRACT

A swimming pool cleaner has a housing. The housing has an intake formed on a bottom section thereof. The intake runs along a width of the bottom section of the housing. A first rolling flap is proximate the intake. The first rolling flap is approximately equal in length to a length of the intake. The first rolling flap runs along the width of the bottom section and is hingly coupled to the bottom section of the housing along a front edge of the intake. The first rolling flap follows a contour of a surface of a swimming pool upon which the swimming pool cleaner is traveling upon to control a water flow into the intake.

7 Claims, 6 Drawing Sheets

SWIMMING POOL CLEANING VEHICLE WITH ADJUSTABLE ROLLERS TO CONTROL WATER FLOW VELOCITY AND METHOD THEREFOR

TECHNICAL FIELD

The present application generally relates to a cleaning device for a swimming pool, and more specifically, to a swimming pool cleaning device that has an adjustable roller located proximate a water intake port to minimize a size of the water intake to optimize a water flow velocity into the swimming pool cleaning device.

BACKGROUND

Swimming pool cleaning devices (hereinafter pool cleaners) are used for maintaining residential and commercial swimming pools in a clean and attractive condition. Pool cleaners have been developed for cleaning and/or dislodging settled debris from the floor and side wall surfaces of the swimming pool, thereby substantially reducing the need for manual vacuuming and/or brushing of the floor and side wall surfaces of the swimming pool A typical pool cleaner may include a housing and a drive member. The drive member may attach to the housing usually through a connection to a chassis. The drive member may include wheels, endless loop tracks and combinations thereof each. In the case of a belt or endless loop track, the track may wrap around the drive and/or idler wheels or rollers. The drive member may also be used to create at least a partial vacuum so that water will be encourage to enter one or more intake ports formed in the housing.

The drive member may be powered by a power source coupled to the drive member. Alternatively, the housing may be coupled to a swimming pool water filtration system by a hose. The swimming pool water filtration system may power the drive members causing the pool cleaning device to travel about within the swimming pool to dislodge and collect settled debris.

In most pool cleaners, the intake port may be located at a bottom surface area of the housing. The size of the intake port may affect the flow rate of water/debris into the intake port. For a given pump flow rate of Q, as the intake port gets larger, the intake velocity of the water decreases such that if the opening is too large, dirt and other sediment may not be pulled into the intake port and may stay on the floor of the swimming pool.

The clearance between the intake port and the floor of the swimming pool may affect the capability to pick up dirt and debris during the cleaning cycle. The intake port cannot be too high above swimming pool floor or the dirt and debris settled on swimming pool floor may not be picked up by the limited partial vacuum and limited water flow by the water pump.

The surfaces along which the pool cleaner run may affect the capability to pick up dirt and debris during the cleaning cycle. For example, obstacles such as swimming pool main drain present, uneven swimming pool surface may affect the water flow into the intake port and may cause the pool cleaner to not pick up dirt and debris as well as to stop moving.

To try and maintain proper functioning and optimum efficiency of pool cleaners, it may be important to try and minimize a size of the untake port in order to optimize the suction into the intake port. By optimizing the suction, one may try to maintain effective fluid suction into the intake port there by increasing the efficiency to clean and dislodge dirt and debris from the pool surfaces even on uneven pool surfaces. Further, optimizing the suction into the intake port may keep the intake port level on the pool surfaces thereby allowing the pool cleaner to travel up and across steeply inclined and vertical surfaces.

Therefore, it would be desirable to provide a system and method that overcomes the above.

SUMMARY

In accordance with one embodiment, a swimming pool cleaner is disclosed. The swimming pool cleaner has a housing having an intake formed on a bottom section thereof. A first rolling flap is proximate the intake. The first rolling flap is of approximately equal length to a length of the intake. The first rolling flap is hingly coupled to the bottom section of the housing along a front edge of the intake. The first rolling flap follows a contour of a surface of a swimming pool upon which the swimming pool cleaner is traveling upon to optimize a water flow into the intake.

In accordance with one embodiment, an automated swimming pool cleaner is disclosed. The swimming pool cleaner has a housing having an intake formed on a bottom section thereof. A pump is located in an interior of the housing. A first rolling flap is proximate the intake. The first rolling flap is of approximately equal length to a length of the intake. The first rolling flap runs along the bottom section and is hingly coupled to the bottom section along a front edge of the intake. The first rolling flap follows a contour of a surface of a swimming pool upon which the swimming pool cleaner is traveling upon to optimize a water flow into the intake. The first rolling flap has a "U" shaped housing hingly coupled to the bottom section of the housing along the rear edge of the intake. A plurality of wheels is rotatably coupled within the "U" shaped housing. The plurality of wheels extend out of the "U" shaped housing and engage the surface of the swimming pool upon which the pool cleaner is traveling upon. A plurality of slots is formed in a bottom area of the "U" shaped housing. An individual wheel of the plurality of wheels extend down through each of the plurality of slots.

In accordance with one embodiment, an automated swimming pool cleaner is disclosed. The swimming pool cleaner has a housing having an intake formed on a bottom section thereof. A pump is located in an interior of the housing. A first rolling flap is proximate the intake. The first rolling flap is approximately equal length to a length of the intake. The first rolling flap is hingly coupled to the bottom section along a front edge of the intake. The first rolling flap follows a contour of a surface of a swimming pool upon which the swimming pool cleaner is traveling upon to optimize a water flow into the intake. The rolling flap comprises: a "U" shaped housing hingly coupled to the bottom section of the housing along the rear edge of the intake; a plurality of wheels rotatably coupled within the "U" shaped housing, the plurality of wheels extending out of the "U" shaped housing and engaging the surface of the swimming pool upon which the pool cleaner is traveling upon; and a plurality of slots formed in a bottom area of the "U" shaped housing, an individual wheel of the plurality of wheels extending down through each of the plurality of slots.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
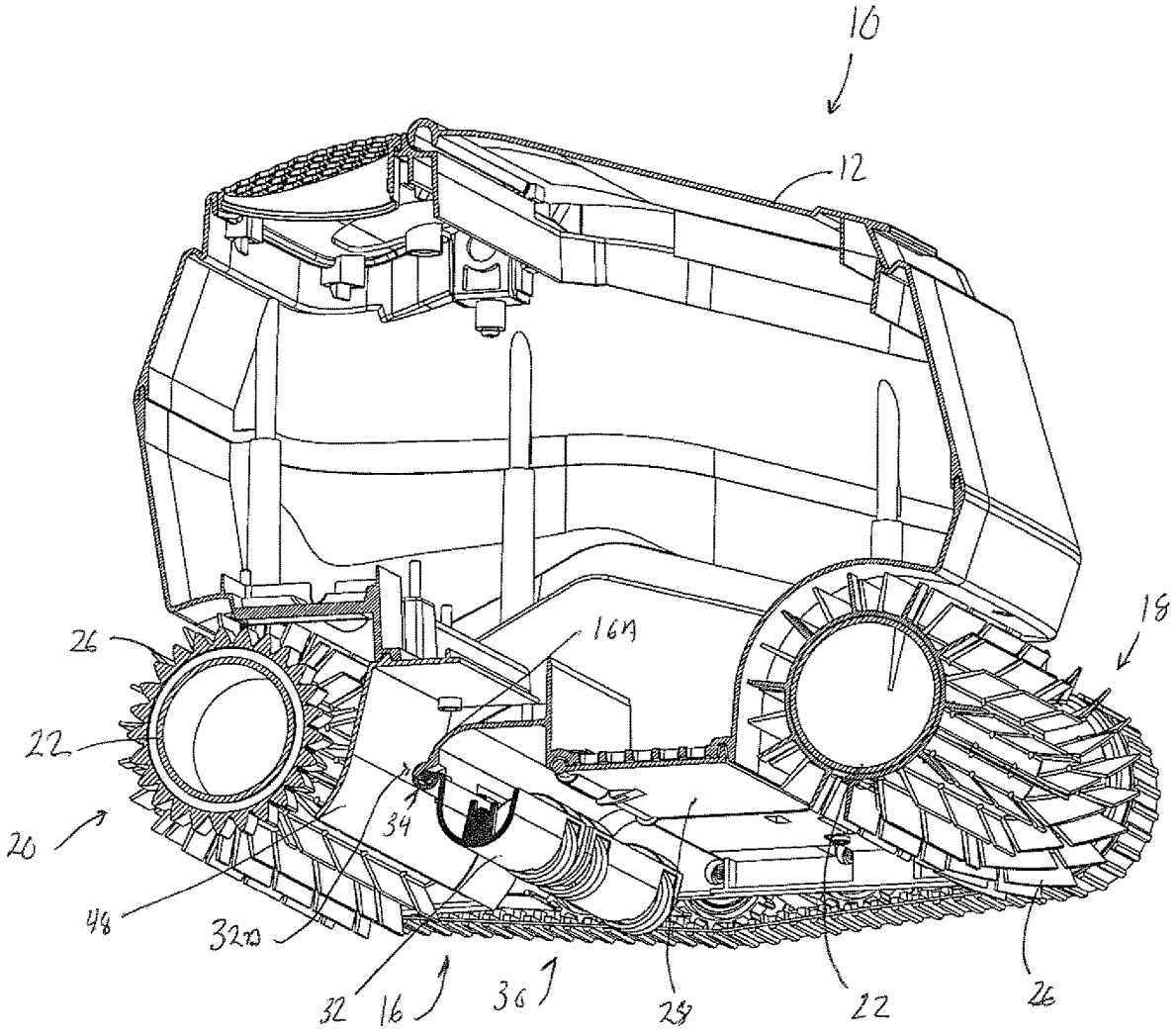
FIG. 1 is a cross-sectional side view of a swimming pool cleaning device having an articulated roller, with the articulated roller in first position in accordance with one aspect of the present application.
Figure 2:
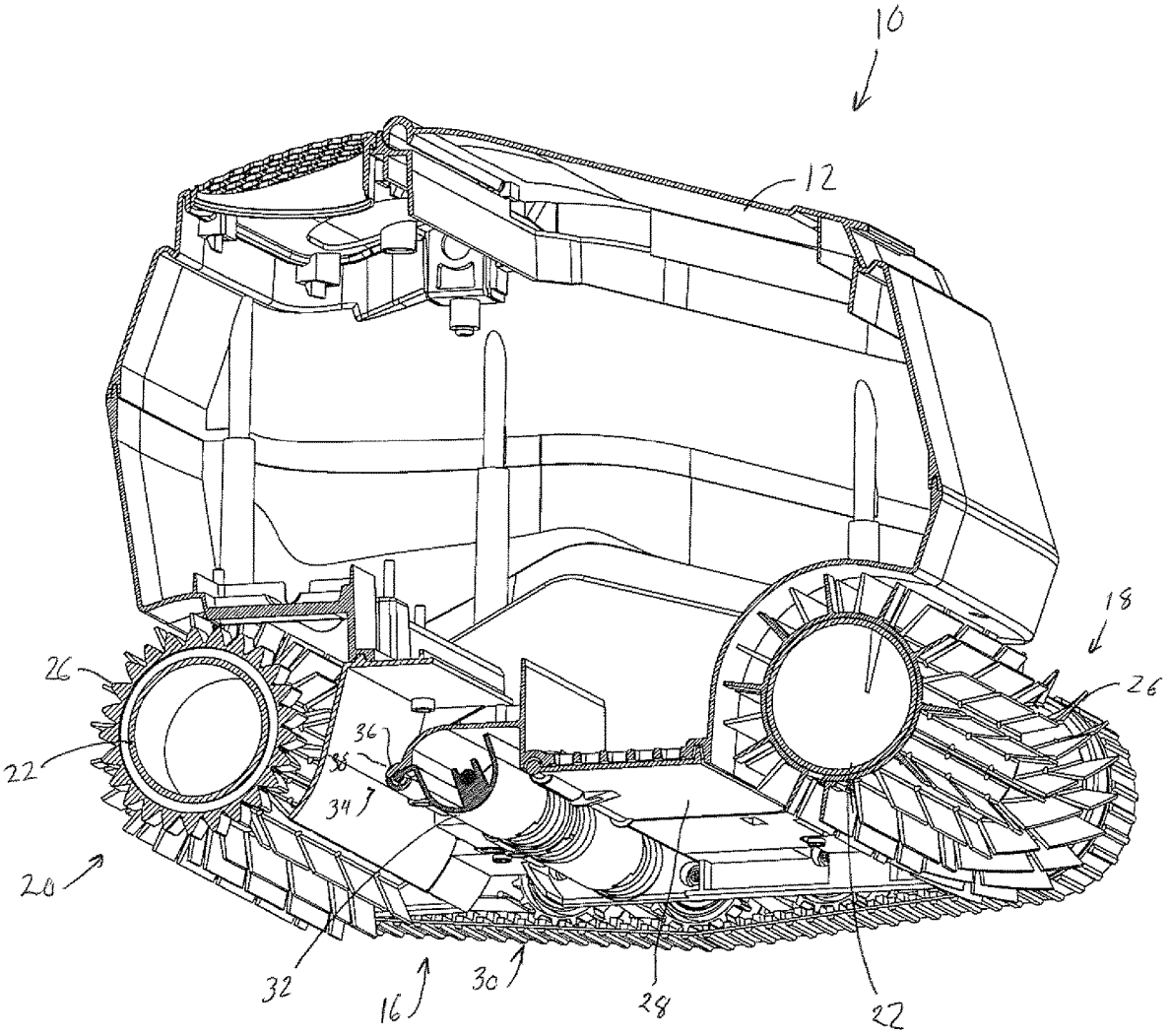
FIG. 2 is a cross-sectional side view of a swimming pool cleaning device of FIG. 1, with the articulated roller in a flexed position in accordance with one aspect of the present application.
Figure 3:
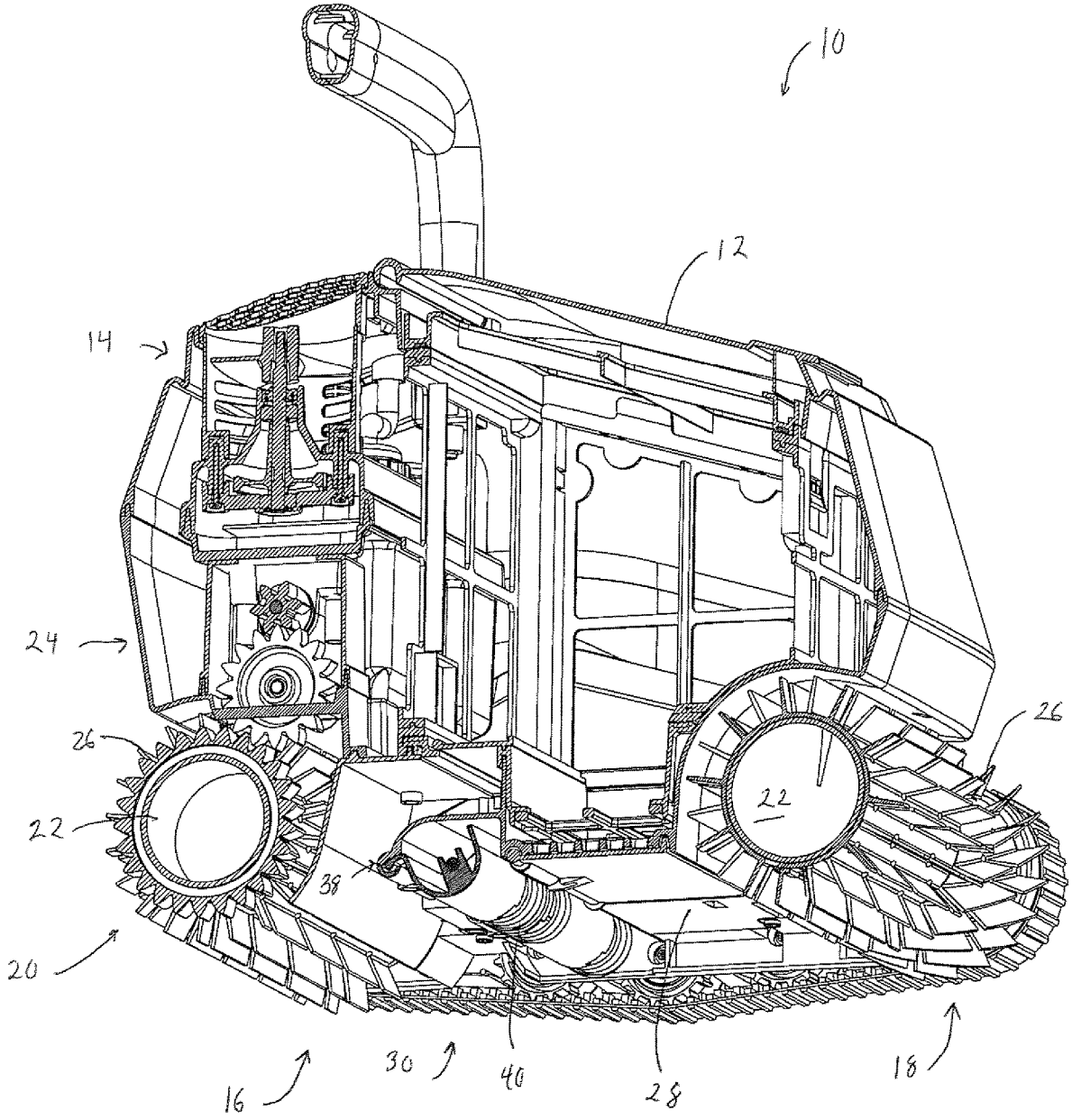
FIG. 3 is a cross-sectional side view of a swimming pool cleaning device of FIG. 1, with the articulated roller in a flexed position, and showing a pump and drive mechanism in accordance with one aspect of the present application.
Figure 4:
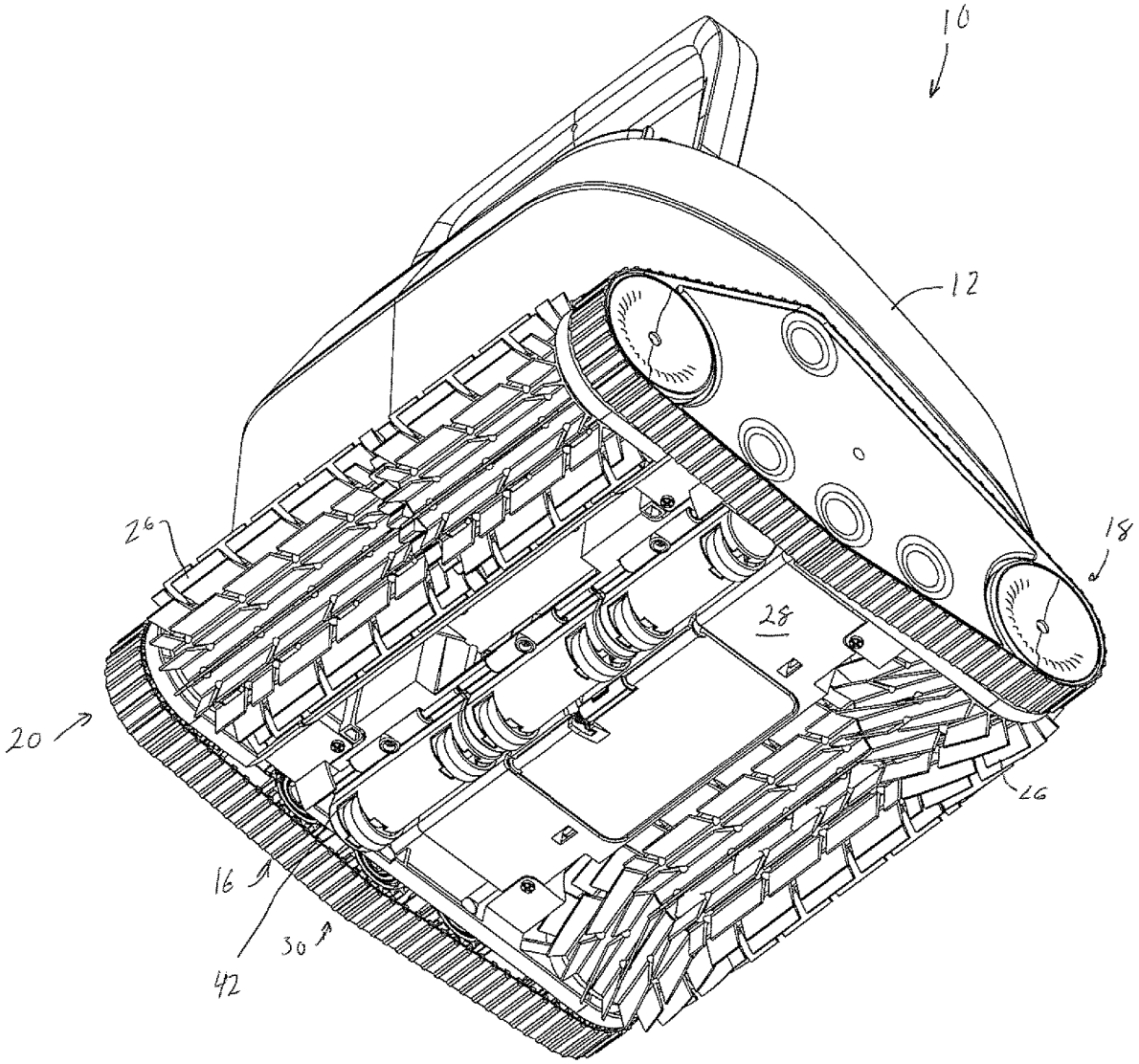
FIG. 4 is a bottom view of the swimming pool cleaning device of FIG. 1 in accordance with one aspect of the present application.
Figure 5:
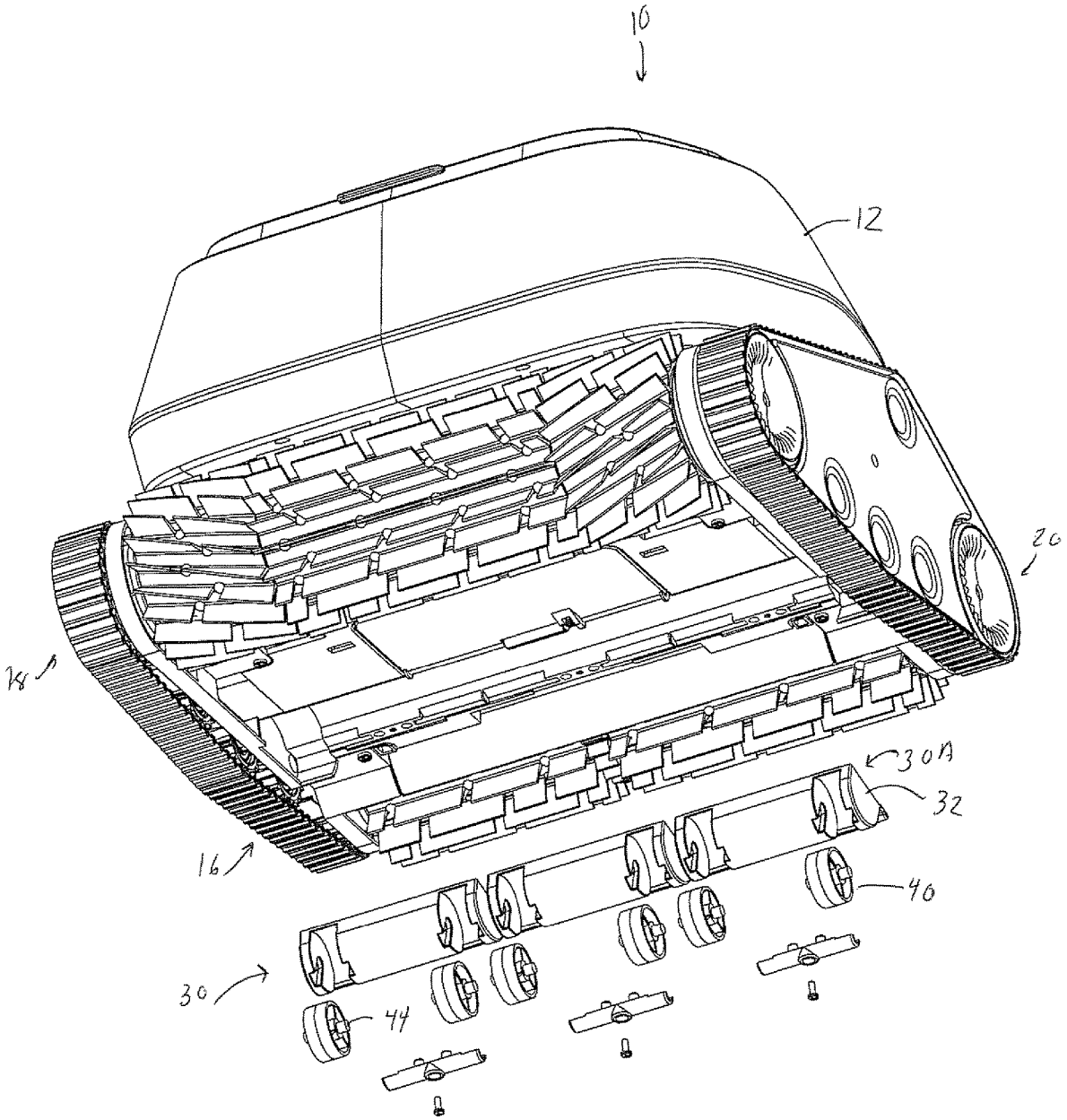
FIG. 5 is an exploded bottom perspective view of the swimming pool cleaning device of FIG. 1 in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure Embodiments of the exemplary system and method provide an automated swimming pool cleaner (hereinafter pool cleaner) that has an articulated roller. The articulated roller remains in contact with the swimming pool surface optimizing a water flow velocity into the pool cleaner. By optimizing the water flow velocity, the pool cleaner may increase the efficiency to clean and dislodge dirt and debris from the swimming pool surfaces even on uneven swimming pool surfaces and may keep the intake port level on the swimming pool surfaces thereby allowing the pool cleaner to travel up and across steeply inclined and vertical surfaces.

Referring to FIGS. 1-5, an automated swimming pool cleaner 10 (hereinafter pool cleaner 10) may be seen. The pool cleaner 10 may have a housing 12. Located within an interior of the housing 12 may be a pump 14. The pump 14 may be used to create a vacuum. When the pump 14 is active, the pump 14 creates a vacuum that causes dirt and debris to be sucked into the housing 12 through one or more intakes 16. It should be noted that the pool cleaner 10 could also be coupled to a pool filtration system. The pool filtration system may be used to generate the vacuum within the interior of the housing 12 to suck up dirt and debris on a floor/wall of the swimming pool.

The pool cleaner 10 may have a first rolling mechanism 18 located in a bottom area of a front section of the housing 12. A second rolling mechanism 20 may be located in a bottom area of a rear section of the housing 12. The first rolling mechanism 18 and the second rolling mechanism 20 may each be formed of a pair of wheels, a roller 22, a combination of the pair of wheels and the roller 22 or similar rolling devices. The pump 14 may be used to power a drive system 24. The drive system 24 may be used to rotate one or more of the first rolling mechanism 18 and/or second rolling mechanism 20. Alternatively, the vacuum generated by pool filtration system may be used to power the drive system 24.

Brushing elements 26 may be formed on the first rolling mechanism 18 and/or the second rolling mechanism 20. The brushing elements 26 may be used to stir up and encourage dirt and debris to enter intakes 16 in the housing 12. The drive system 24 may be used to rotate the first rolling mechanism 18 and/or the second rolling mechanism 20 thereby rotating the brushing elements 26.

The intake 16 may be formed in a bottom section of the housing 12. When the pump 14 and/or the pool filtration system creates a vacuum within the housing 12, water as well as any dirt and/or debris may be drawn into the intake 16. In the embodiments shown in the FIGS. 1-5, the intake 16 may be formed in a bottom area of the housing 12. The intake 16 may run along the width of the bottom section 28 of the housing 12. In the present embodiment, the intake 16 may be formed in a rear area in the bottom section 28 of the housing 12 proximate the second rolling mechanism 20.

One or more articulated rolling flaps 30 (hereinafter rolling flaps) may be coupled to the housing 12. The rolling flap 30 may be configured to remain in contact with the swimming pool surface optimizing a water flow velocity into the pool cleaner 10. By adjusting to the uneven surfaces of the swimming pool, the rolling flap 30 may keep the water flow velocity into the intake 16 consistent, thereby increasing the efficiency to clean and dislodge dirt and debris from the swimming pool surfaces on uneven swimming pool surfaces and may keep the intake port level on the swimming pool surfaces thereby allowing the pool cleaner 10 to travel up and across steeply inclined and vertical surface.

The rolling flap 30 may be proximate the intake 16. The rolling flap 30 may be approximately of equal length to the length of the intake 16. In the present embodiment, the rolling flap 30 may run along the width of the bottom section 28 of the housing 12 along a front edge 16A of the intake 16.

The rolling flap 30 may be formed of a single unit. Alternatively, as may be seen more clearly in FIGS. 4-5, the rolling flap 30 may be formed of a plurality of rolling flap sections 30A.

In accordance with one embodiment, the rolling flap 30 and/or each rolling flap section 30A may formed of a "U" shaped housing 32. The "U" shaped housing 32 may be formed of a sturdy light weight material. For example, plastic material such as High-density polyethylene (HDPE), Polyvinyl chloride (PVC) or the like may be used. The above is given as examples and should not be seen in a limiting manner.

One end 32A of the "U" shaped housing 32 may be hingly coupled to the bottom section 28 of the housing 12. In the present embodiment, the end 32A may have a tab 34 having a cylindrical end 36. The cylindrical end 36 may be housed in "C" holder 38 formed at one end of the intake 16. Housing the cylindrical end 36 within the "C" holder 38 may allow the "U" shaped housing 32 and hence the rolling flap 30 to rotate and move about the "C" holder 38.

A plurality of wheels 40 may be rotatably coupled within the "U" shaped housing 32. The plurality of wheels 40 may extend out of the "U" shaped housing 32 and engage the surface of the swimming pool upon which the pool cleaner 10 is traveling upon. The plurality of wheels 40 may be used to keep a bottom surface 30A of the rolling flap 30 a minimum distance above the surface of the swimming pool. This may allow the rolling flap 30 to smoothly roll upon and follow the contour of the swimming pool surface upon which the pool cleaner 10 is traveling upon.

In accordance with one embodiment, the "U" shaped housing 32 may have a plurality of slots 42. The slots 42 may be formed in a bottom area of the "U" shaped housing 32. The slots 42 may allow the plurality of wheels 40 to extend out of the bottom surface of the "U" shaped housing 32 and engage the surface of the swimming pool upon which the pool cleaner 10 is traveling upon.

An axle assembly 44 may be used to rotatably couple the plurality of wheels 40 within the "U" shaped housing 32. In the embodiment shown in the FIGS. 1-5, a pair of tab members 46 may be formed within the "U" shaped housing 32. The tab members 46 may house the axle assembly 44 and allow the axle assembly 44 and hence the plurality of wheel 40 to rotate freely within the "U" shaped housing 32.

The above is just one embodiment of the rolling flap 30. The rolling flap 30 may take on other embodiments without departing from the spirit and scope of the present invention. For example, in accordance with one embodiment, the rolling flap 30 may be formed of a roller hingly coupled to the bottom section 28 of the housing 12. The roller may run along the width of the bottom section 28 of the housing 12 along a front edge 16A of the intake 16. The roller may be configured to remain in contact with the swimming pool surface regulating the water flow velocity into the pool cleaner 10. By adjusting to the uneven surfaces of the swimming pool, the roller may keep the water flow velocity into the intake 16 consistent.

A wheel skirt 48 may be positioned around the second rolling mechanism 20. The wheel skirt 48 may be approximately of equal length to the length of the intake 16. In the present embodiment, the wheel skirt 48 may run along the width of the bottom section 28 of the housing 12 along a rear edge 16B of the intake 16 proximate the second rolling mechanism 20.

In operation, as the pool cleaner 10 moves along the swimming pool floor/wall, the plurality of wheels 40 that extend out of the "U" shaped housing 32 engage the surface of the swimming pool upon which the pool cleaner 10 is traveling upon. The plurality of wheels 40 may be used to keep a bottom surface 30A of the rolling flap 30 a minimum distance above the surface of the swimming pool. This may allow the rolling flap 30 to smoothly roll upon and follow the contour of the swimming pool surface upon which the pool cleaner 10 is traveling upon. By adjusting to the uneven surfaces of the swimming pool, the rolling flap 30 may keep the water flow velocity into the intake 16 consistent.

Figure 6:
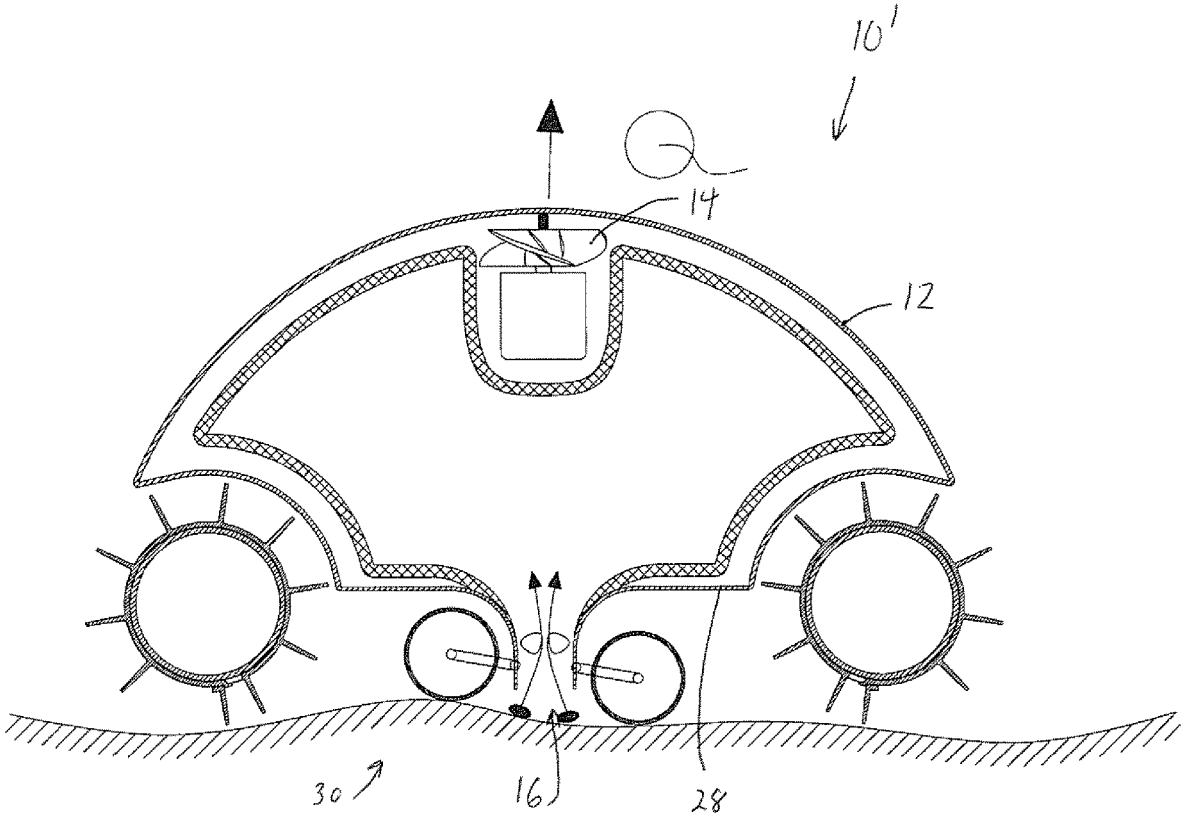
FIG. 6 is a cross-sectional side view of a swimming pool cleaning device having a pair of articulated rollers, with the articulated roller in first position in accordance with one aspect of the present application.

Referring to FIG. 6, another embodiment of an automated swimming pool cleaner 10' (hereinafter pool cleaner 10) may be seen. The pool cleaner 10' may have a housing 12. Located within an interior of the housing 12 may be a pump 14. The pump 14 may be used to create a vacuum. When the pump 14 is active, the pump 14 creates a vacuum that causes dirt and debris to be sucked into the housing 12 through one or more intakes 16. It should be noted that the pool cleaner 10' could also be coupled to a pool filtration system. The pool filtration system may be used to generate the vacuum within the interior of the housing 12 to suck up dirt and debris on a floor/wall of the swimming pool.

The pool cleaner 10' may have a first rolling mechanism 18 located in a bottom area of a front section of the housing 12. A second rolling mechanism 20 may be located in a bottom area of a rear section of the housing 12. The first rolling mechanism 18 and the second rolling mechanism 20 may each be formed of a pair of wheels, a roller 22, a combination of the pair of wheels and the roller 22 or similar rolling devices. The pump 14 may be used to power a drive system 24. The drive system 24 may be used to rotate one or more of the first rolling mechanism 18 and/or second rolling mechanism 20. Alternatively, the vacuum generated by pool filtration system may be used to power the drive system 24.

Brushing elements 26 may be formed on the first rolling mechanism 18 and/or the second rolling mechanism 20. The brushing elements 26 may be used to stir up and encourage dirt and debris to enter intakes 16 in the housing 12. The drive system 24 may be used to rotate the first rolling mechanism 18 and/or the second rolling mechanism 20 thereby rotating the brushing elements 26.

The intake 16 may be formed in a bottom section of the housing 12. When the pump 14 and/or the pool filtration system creates a vacuum within the housing 12, water as well as any dirt and/or debris may be drawn into the intake 16. In the embodiments shown in the FIG. 6, the intake 16 may be formed in a center area of the housing 12. The intake 16 may run along the width of the bottom section 28 of the housing 12. In the present embodiment, the intake 16 may be formed in a center area in the bottom section 28 of the housing 12 between the first rolling mechanism 18 and the second rolling mechanism 20.

A pair of articulated rolling flaps 30 (hereinafter rolling flaps) may be coupled to the housing 12. The rolling flap 30 may be configured to remain in contact with the swimming pool surface optimizing a water flow velocity into the pool cleaner 10. By adjusting to the uneven surfaces of the swimming pool, the rolling flap 30 may keep the water flow velocity into the intake 16 consistent, thereby increasing the efficiency to clean and dislodge dirt and debris from the swimming pool surfaces on uneven swimming pool surfaces and may keep the intake port level on the swimming pool surfaces thereby allowing the pool cleaner 10 to travel up and across steeply inclined and vertical surface.

In the present embodiment, each of the pair of rolling flaps 30 may be proximate the intake 16. The rolling flaps 30 may be approximately of equal length to the length of the intake 16. In the present embodiment, one of the pair of rolling flaps 30 may run along the width of the bottom section 28 of the housing 12 along a front edge 16A of the intake 16 while a second of the pair of rolling flaps 30 may run along the width of the bottom section 28 of the housing 12 along a rear edge 16B of the intake 16.

The rolling flaps 30 maybe formed of a single unit. Alternatively, the rolling flaps 30 may be formed of a plurality of rolling flap sections 30A.

In accordance with one embodiment, the rolling flap 30 and/or each rolling flap section 30A may formed of a "U" shaped housing 32. The "U" shaped housing 32 may be formed of a sturdy light weight material. For example, plastic material such as High-density polyethylene (HDPE), Polyvinyl chloride (PVC) or the like may be used. The above is given as examples and should not be seen in a limiting manner.

One end 32A of the "U" shaped housing 32 may be hingly coupled to the bottom section 28 of the housing 12. In the present embodiment, the end 32A may have a tab 34 having a cylindrical end 36. The cylindrical end 36 may be housed in "C" holder 38 formed at one end of the intake 16. Housing the cylindrical end 36 within the "C" holder 38 may allow the "U" shaped housing 32 and hence the rolling flap 30 to rotate and move about the "C" holder 38.

A plurality of wheels 40 may be rotatably coupled within the "U" shaped housing 32. The plurality of wheels 40 may extend out of the "U" shaped housing 32 and engage the surface of the swimming pool upon which the pool cleaner 10' is traveling upon. The plurality of wheels 40 may be used to keep a bottom surface 30A of the rolling flap 30 a minimum distance above the surface of the swimming pool. This may allow the rolling flap 30 to smoothly roll upon and follow the contour of the swimming pool surface upon which the pool cleaner 10' is traveling upon.

In accordance with one embodiment, the "U" shaped housing 32 may have a plurality of slots 42. The slots 42 may be formed in a bottom area of the "U" shaped housing 32. The slots 42 may allow the plurality of wheels 40 to extend out of the bottom surface of the "U" shaped housing 32 and engage the surface of the swimming pool upon which the pool cleaner 10' is traveling upon.

An axle assembly 44 may be used to rotatably couple the plurality of wheels 40 within the "U" shaped housing 32. A pair of tab members 46 may be formed within the "U" shaped housing 32. The tab members 46 may house the axle assembly 44 and allow the axle assembly 44 and hence the plurality of wheel 40 to rotate freely within the "U" shaped housing 32.

The above is just one embodiment of the rolling flap 30. The rolling flap 30 may take on other embodiments without departing from the spirit and scope of the present invention. For example, in accordance with one embodiment, the rolling flap 30 may be formed of a roller hingly coupled to the bottom section 28 of the housing 12. In the present embodiment, one roller may run along the width of the bottom section 28 of the housing 12 along the front edge 16A of the intake 16 and another roller may run along the width of the bottom section 28 of the housing 12 along the rear edge 16B. The rollers may be configured to remain in contact with the swimming pool surface regulating the water flow velocity into the pool cleaner 10. By adjusting to the uneven surfaces of the swimming pool, the roller may keep the water flow velocity into the intake 16 consistent.

In operation, as the pool cleaner 10' moves along the swimming pool floor/wall, the plurality of wheels 40 that extend out of the "U" shaped housing 32 engage the surface of the swimming pool upon which the pool cleaner 10 is traveling upon. The plurality of wheels 40 may be used to keep a bottom surface 30A of the rolling flap 30 a minimum distance above the surface of the swimming pool. This may allow the rolling flaps 30 to smoothly roll upon and follow the contour of the swimming pool surface upon which the pool cleaner 10 is traveling upon. The rolling flaps 30 adjust to the uneven surfaces of the swimming pool thereby keeping the water flow velocity into the intake 16 consistent.

The foregoing description is illustrative of particular embodiments of the application, but is not meant to be a limitation upon the practice thereof. The following claims, including all equivalents thereof, are intended to define the scope of the application.

What is claimed is:

1. A swimming pool cleaner comprising:

a housing having an intake formed on a bottom section thereof;

a first rolling flap proximate the intake, the first rolling flap being of approximately equal length to a length of the intake and formed of a single unit, the first rolling flap hingly coupled to the bottom section along a front edge of the intake, the first rolling flap following a contour of a surface of a swimming pool upon which the swimming pool cleaner is traveling upon to optimize a water flow into the intake;

wherein the first rolling flap comprises:

a "U" shaped housing hingly coupled to the bottom section of the housing along the rear edge of the intake; and a plurality of wheels rotatably coupled within the "U" shaped housing, the plurality of wheels extending out of the "U" shaped housing and engaging the surface of the swimming pool upon which the pool cleaner is traveling upon.

2. The swimming pool cleaner of claim 1, comprising a plurality of slots formed in a bottom area of the "U" shaped housing, an individual wheel of the plurality of wheels extending down through each of the plurality of slots.

3. The swimming pool cleaner of claim 1, comprising:

a tab formed on one end of the "U" shaped housing;

a cylindrical end formed on a distal end of the tab; and a "C" holder formed on each end of the intake, the cylindrical end housed in the "C" holder.

4. The swimming pool cleaner of claim 1, comprising a wheel skirt positioned around a second rolling mechanism attached on a rear section of the housing, the wheel skirt of approximately equal length to the length of the intake.

5. An automated swimming pool cleaner comprising:

a housing having an intake formed on a bottom section thereof;

a pump located in an interior of the housing;

a first rolling flap proximate the intake, the first rolling flap being of approximately equal length to a length of the intake, the first rolling flap running along a width of the bottom section and hingly coupled to the bottom section along a front edge of the intake, the first rolling flap following a contour of a surface of a swimming pool upon which the swimming pool cleaner is traveling upon to optimize a water flow into the intake, wherein the first rolling flap is formed of a plurality of rolling flap sections, wherein each of the rolling flap sections comprises:

a "U" shaped housing hingly coupled to the bottom section of the housing along the rear edge of the intake;

a plurality of wheels rotatably coupled within the "U" shaped housing, the plurality of wheels extending out of the "U" shaped housing and engaging the surface of the swimming pool upon which the pool cleaner is traveling upon; and a plurality of slots formed in a bottom area of the "U" shaped housing, an individual wheel of the plurality of wheels extending down through each of the plurality of slots.

6. The automated swimming pool cleaner of claim 5, comprising:

a tab formed on one end of the "U" shaped housing;

a cylindrical end formed on a distal end of the tab; and a "C" holder formed on each end of the intake, the cylindrical end housed in the "C" holder.

7. The automated swimming pool cleaner of claim 5, comprising a wheel skirt positioned around a second rolling mechanism attached on a rear section of the housing, the wheel skirt of approximately equal length to the length of the intake.

* * * * *